US010006192B2

(12) United States Patent
Arnott et al.

(10) Patent No.: US 10,006,192 B2
(45) Date of Patent: Jun. 26, 2018

(54) AUTOMATIC FLOOR CLEANING MACHINE AND PROCESS

(71) Applicants: Brian Arnott, Brielle, NJ (US); Melissa Arnott, Brielle, NJ (US)

(72) Inventors: Brian Arnott, Brielle, NJ (US); Melissa Arnott, Brielle, NJ (US)

( * ) Notice: Subject to any disclaimer, the term of this patent is extended or adjusted under 35 U.S.C. 154(b) by 0 days. days.

(21) Appl. No.: 15/209,719

(22) Filed: Jul. 13, 2016

(65) Prior Publication Data

US 2018/0016778 A1 Jan. 18, 2018

(51) Int. Cl.

| | |
|---|---|
| ***A47L 9/28*** | (2006.01) |
| ***E03D 9/00*** | (2006.01) |
| ***A47L 11/40*** | (2006.01) |
| ***A47L 11/30*** | (2006.01) |

(52) U.S. Cl.

CPC ..... *E03D 9/002* (2013.01); *A47L 11/30* (2013.01); *A47L 11/4011* (2013.01); *A47L 11/4016* (2013.01); *A47L 11/4041* (2013.01); *A47L 11/4044* (2013.01); *A47L 11/4083* (2013.01); *A47L 11/4088* (2013.01); *A47L 11/4091* (2013.01); *A47L 2201/04* (2013.01); *A47L 2201/06* (2013.01)

(58) Field of Classification Search

CPC ..... A47L 11/4044; A47L 11/4088; A47L 11/4083; A47L 11/4016; A47L 11/4011; A47L 11/4041; A47L 11/30; A47L 11/4091; A47L 2201/04; A47L 2201/06; A47L 9/28; E03D 9/002

See application file for complete search history.

(56) References Cited

U.S. PATENT DOCUMENTS

| | | | | |
|---|---|---|---|---|
| 3,401,420 A | | 9/1968 | Lofgren | |
| 4,207,649 A | * | 6/1980 | Bates | A47L 11/34 15/319 |
| 4,692,951 A | | 9/1987 | Taki et al. | |
| 5,012,886 A | | 5/1991 | Jonas et al. | |
| 5,199,996 A | | 4/1993 | Jonas et al. | |
| 5,613,271 A | * | 3/1997 | Thomas | A47L 7/0009 15/321 |

(Continued)

FOREIGN PATENT DOCUMENTS

| | | |
|---|---|---|
| JP | 6136809 A | 5/1994 |
| JP | 2016-87384 A | 5/2016 |

(Continued)

OTHER PUBLICATIONS

V. Woods, et al., "An Investigation into the Design and Use of Workplace Cleaning Equipment," International Journal of Industrial Ergonomics, 35 (2005) 247-266.

(Continued)

*Primary Examiner* — David Redding

(74) *Attorney, Agent, or Firm* — Giaccio LLC; Anthony Giaccio

(57) ABSTRACT

A floor cleaning device for automatically cleaning in front of and around lavatory appliances like urinals, toilets, sinks, and hand drying devices, wherein the floor cleaning device has a fixed unit, a mobile unit, and an extension mechanism connected to the fixed unit and the mobile unit that sprays disinfectant solution and recovers or removes waste solution during the extension or retraction of the mobile unit from and to the fixed unit.

25 Claims, 19 Drawing Sheets

(56) References Cited

U.S. PATENT DOCUMENTS

| | | | | |
|---|---|---|---|---|
| 5,628,086 | A | 5/1997 | Knowlton et al. | |
| 6,131,237 | A * | 10/2000 | Kasper | A47L 5/225 15/320 |
| 6,349,430 | B1 | 2/2002 | Forslund | |
| 6,370,453 | B2 | 4/2002 | Sommer | |
| 6,997,395 | B2 * | 2/2006 | Kawamoto | B08B 3/026 134/10 |
| 8,122,555 | B2 | 2/2012 | Kim | |
| 8,448,293 | B2 * | 5/2013 | Sepke | A47L 9/0483 15/371 |
| 8,887,340 | B2 | 11/2014 | Pedlar et al. | |
| 2012/0017368 | A1 | 1/2012 | Lostal Grasa | |
| 2013/0092190 | A1 | 4/2013 | Yoon et al. | |
| 2013/0175802 | A1 | 7/2013 | Breau et al. | |
| 2015/0033496 | A1 | 2/2015 | Pedlar et al. | |

FOREIGN PATENT DOCUMENTS

| | | | |
|---|---|---|---|
| KR | 10-2011-0110661 | A | 7/2011 |
| WO | 2004017805 | A1 | 3/2004 |

OTHER PUBLICATIONS

Translation of Abstract of JP6136809A, Toto Ltd, May 17, 1994.
English Language Translation of JP-2016-87384-A.
English Language Translation of KR-10-2011-0110661-A.

* cited by examiner

AUTOMATIC FLOOR CLEANING MACHINE AND PROCESS

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

Field of the Invention

This invention generally relates to automatic floor cleaning machines.

Description of Related Art

Those who frequent public men's restrooms are all too familiar with unsanitary conditions that exist on the floor in front of and around urinals. Despite the best efforts of the cleaning workforce using traditional cleaning tools, pools of urine collect in front of and in the area on the floor around the urinal. Not desiring to step in a pool of urine, subsequent users are forced to stand further and further away from the urinal, which winds up contributing even further to the problem.

U.S. Patent Publication 2015/0033496 and related U.S. Pat. No. 8,887,340 disclose a mobile floor cleaning apparatus with a chassis supported by a plurality of wheels with one steerable via a steering wheel interconnected to a housing, wherein the chassis has a plurality of movable housing members to operate in tight spaces.

U.S. Pat. No. 8,448,293 discloses a mobile wet extractor floor brush adapted for movement on a surface being cleaned having a base assembly for movement on the surface, an operating handle for controlling the movement of the wet extractor pivotally attached to the base assembly, a supply tank having an outlet, a recovery tank having an inlet and an outlet, and an agitator.

U.S. Pat. No. 6,370,453 discloses a self-moving service robot for automatic examination of floor surfaces and for suction of dust from floor surfaces that is programed to explore areas and detect potential obstacles using sensors.

U.S. Pat. No. 5,199,996 discloses a mobile apparatus for cleaning floors having a cleaning device placed on a first side of the apparatus to perform cleaning perpendicular to the general direction of advance of the apparatus.

U.S. Pat. No. 5,012,886 discloses a self-guided mobile unit and cleaning apparatus that follows guides such as walls or other obstacles, engages the guides with a detector element and controls the steering of the apparatus in response to the level of forces sensed by the detector.

U.S. Pat. No. 3,401,420 discloses a vacuum cleaner mounted to a maid's cart but rotatable around a vertical axis for winding of the vacuum hose and cord storage to facilitate cleaning while the vacuum cleaner remains on the maid's cart.

JP6136809 discloses a toilet divided into two parts, an under floor toilet bowl body and a floor cover above the floor, wherein the floor cover is cleaned in a cleaning chamber provided on the toilet booth side while the floor surface is cleaned with a brush-cleaning device or the like.

U.S. Patent Publication 2013-0092190 discloses a robot cleaner that travels on a floor with an obstacle sensing unit and an auxiliary cleaning unit mounted to the bottom of the robot body, such that the auxiliary cleaning unit is extendable or retractable when an obstacle is sensed.

U.S. Patent Publication 2013-0175802 discloses a powered apparatus for fluid applications having a housing dimensioned and configured for mounting in a fluid conduit.

U.S. Pat. No. 8,122,555 discloses a mobile floor cleaning apparatus capable of maximizing a user's convenience by an automatic operation, minimizing jolt or vibration and realizing enhanced endurance and safety with first and second movable members rectilinearly reciprocating along the same straight line in opposite directions with each other.

WIPO Publication WO 2004-017805 discloses a mobile floor cleaning apparatus with at least one tool that impinges on the floor, at least one vapor outlet, and at least one cleaner outlet.

U.S. Pat. No. 5,628,086 discloses a mobile floor cleaning apparatus with four wheels, two of which are steerable by a steering wheel, to permit tight turns.

International Journal of Industrial Ergonomics 35 (2005) 247-266 discloses concerns of design and use of workplace cleaning equipment by cleaning workforce using demanding and labor intensive buffing machines, floor polishing machines, wet and dry vacuums, and other cleaning tools.

BRIEF SUMMARY OF THE INVENTION

The present invention relates to an automatic floor cleaner and recovery unit comprising a cleaning and recovery unit wherein the cleaning and recovery unit comprises a fixed unit, a mobile unit, and an extension mechanism connected to the fixed unit and the mobile unit to permit the extension and retraction of the mobile unit from and to the fixed unit. The present invention further relates to an automatic floor cleaner and recovery unit, wherein the fixed unit comprises a controller, a sensor, a motor, a power source, a disinfectant solution tank, a vacuum, and a recovery tank; wherein the fixed unit is mounted to a floor or wall in proximity to a urinal, toilet, sink, or hand drying device; wherein the controller and the sensor control the activation of the motor for the extension or retraction of the mobile unit; wherein the power source is AC or DC; wherein the sensor is mounted on the exterior of the cleaning and recovery unit with a line of view in the direction of a target area of floor, and, alternatively, wherein the sensor is mounted on a urinal, toilet, sink, or hand drying device; wherein the disinfectant solution tank is connected by tubing to the mobile unit for spraying disinfectant solution onto a target area of floor upon extension of the mobile unit from the fixed unit; wherein the timing of spraying disinfectant solution is controlled by the controller; wherein the vacuum further comprises its own collection tank, fan, motor, and exhaust port; wherein the vacuum is connected by tubing to the mobile unit for recovery of urine and disinfectant solution from the target area of floor upon retraction of the mobile unit to the fixed unit; wherein timing of the vacuum is controlled by the controller; wherein the vacuum collection tank is connected by tubing to the recovery tank; wherein an intake port of the vacuum is connected by tubing to the fixed unit in proximity of the mobile unit for the recovery of urine and disinfectant solution from a target area of floor upon retraction of the mobile unit to the fixed unit; wherein the recovery tank is connected to an external drain or replaced by tubing connected directly to the external drain; wherein the fixed unit is integrated into a urinal, toilet, sink, or hand drying device; wherein the fixed unit is housed with a urinal, toilet, sink, or hand drying device; wherein the fixed unit is a cartridge insertable and removable from a cavity in the urinal, toilet, sink, or hand drying device; wherein the mobile unit further comprises a spray port for spraying disinfectant solution onto a target area of floor, a recovery port for suctioning solution from the target area, and a scrapping implement for contacting the target area and collecting the solution from the target area upon retraction of the mobile unit to the fixed unit; wherein the mobile unit further comprises a brush; wherein the scrapping implement is a squeegee; and wherein the extension mechanism first lifts and then extends the mobile unit and then the retraction mechanism first drops and retracts the mobile unit.

The present invention relates to a method of automatically cleaning a floor surface using a cleaning and recovery unit comprising the steps of (a) activating a sensor, (b) extending a mobile unit, (c) spraying disinfectant solution onto a target area of floor during extension of the mobile unit, (d) contacting the mobile unit with the floor, and (e) retracting the mobile unit over the target area. The present invention further relates to a method of automatically cleaning a floor surface, wherein the step of retracting the mobile unit further comprises the steps of scraping and suctioning; wherein the step of activating a sensor is replaced by activation on a timed basis; and wherein the step of retracting is replaced by spraying disinfectant solution onto a target area of floor during retraction of the mobile unit.

The present invention relates to an automatic floor cleaner comprising a cleaning unit, wherein the cleaning unit comprises a fixed unit, a mobile unit, and an extension mechanism connected to the fixed unit and the mobile unit to permit the extension and retraction of the mobile unit from and to the fixed unit; wherein the fixed unit comprises a controller, a sensor, a motor, a power source, and a disinfectant solution tank; wherein the disinfectant solution tank is connected by tubing to the mobile unit for spraying disinfectant solution onto a target area of floor upon extension of the mobile unit from the fixed unit.

The present invention relates to a method of automatically cleaning a floor surface, comprising the steps of (a) activating the sensor, (b) extending the mobile unit, (c) spraying disinfectant solution onto the target area of floor during extension of the mobile unit, and (d) retracting the mobile unit. The present invention further relates to a method of automatically cleaning a floor surface, wherein the mobile unit is extended on a timed delay at predetermined time periods after the sensor is activated.

BRIEF DESCRIPTION OF THE DRAWINGS

For a better understanding of the present invention, reference is made to the following examples and drawings. Referring to the appended drawings.

Figure 1:
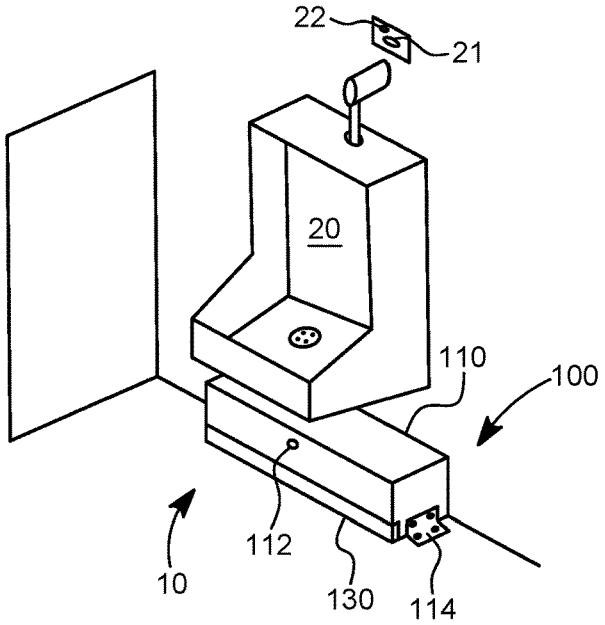
FIG. 1 is a perspective view of a device according to a non-limiting embodiment of the present invention that is mounted to a floor under a wall-mounted urinal.

Other features and aspects of the present invention will become more fully apparent from the following detailed description of some example embodiments, the appended claims, and the accompanying drawings.

DETAILED DESCRIPTION OF THE PREFERRED EMBODIMENTS

The inventor of the present application has recognized that there is a need for automatic floor cleaning machines, particularly in commercial, industrial, and institutional venues.

An automatic floor cleaning and recovery unit in accordance with the present invention comprises a fixed unit, a mobile unit, an extension mechanism connected to the fixed unit and the mobile unit to permit the extension and retraction of the mobile unit from and to the fixed unit. In alternative non-limiting embodiments, the automatic floor cleaning and recovery unit may be wall-mounted or floor-mounted adjacent to a wall-mounted or floor-mounted urinal, adjacent to a wall-mounted or floor-mounted toilet, adjacent to a wall-mounted or floor-mounted sink, or adjacent to a wall-mounted or floor-mounted hand drying device. In further non-limiting alternative embodiments, the fixed unit is housed within a lavatory appliance, such as a urinal, toilet, sink, or hand drying device. In further non-limiting alternative embodiments, the fixed unit is a cartridge that is insertable and removable from a cavity in the urinal, toilet, sink, or hand drying device. In further, non-limiting alternative embodiments, the fixed unit is integrated into a urinal, toilet, sink, or hand drying device.

The fixed unit comprises a controller, a sensor, a motor, a power source, a disinfectant solution tank, a vacuum, and a recovery tank. Preferably, the fixed unit is positioned in proximity to a target area of a floor or surface for cleaning.

The controller and the sensor control the activation of the motor for the extension and retraction of the mobile unit. The sensor is preferably mounted on the exterior of the cleaning and recovery unit with a line of view in the direction of a target area of floor or surface to be cleaned. Alternatively, the sensor may be mounted adjacent to the fixed unit or adjacent to the lavatory appliance. The sensor optionally is mounted on the adjacent urinal, toilet, sink, or hand drying device. In other alternative embodiments, the controller of the fixed unit uses the sensor of the adjacent lavatory appliance. The cleaning and recovery unit may also be designed to synchronize with the sensor of the adjacent lavatory appliance.

The power source can be either AC or DC. The cleaning and recovery unit can be plugged into standard electrical outlets or wired directly to an electrical source. For areas that do not have electrical outlets or do not have electrical outlets in a convenient location, the cleaning and recovery unit can be powered by a battery. The battery source may be rechargeable or disposable. The cleaning and recovery unit can also be powered by the urinal, toilet, sink, or hand drying device, either when wall or floor-mounted or when housed within or integrated into the urinal, toilet, sink, or hand drying device.

The disinfectant solution tank is housed in the fixed unit and is connected by tubing to the mobile unit for spraying disinfectant solution onto the target area of floor upon extension of the mobile unit from the fixed unit. In alternative non-limiting embodiments of the present invention, the disinfectant solution tank is not housed inside the fixed unit but is wall-mounted next to and connected to the fixed unit by way of tubing. This would provide additional space in the fixed unit for a larger recovery tank, allow additional space for a larger disinfectant solution tank, and decrease the possibility of any confusion during maintenance of the disinfectant solution tank and the recovery tank. The timing of spraying disinfectant solution is controlled by the controller. The disinfectant solution tank may have a port for external filling of additional disinfectant solution. In an alternative non-limiting embodiment, the disinfectant solution tank is a detachable cartridge or bag that can be replaced as needed. Optionally, a window or other indicator is provided on the exterior of the disinfectant solution tank and the fixed unit so that the level of disinfectant solution is visible or otherwise indicated.

The disinfectant solution tank preferably contains a liquid cleaner for household, commercial, industrial, and institutional use, and, optionally, has anti-bacterial, anti-microbial and/or anti-viral properties. It is also preferable that the liquid cleaner be quick drying.

Upon retraction of the mobile unit to the fixed unit, a vacuum recovers any waste solution and/or debris. The vacuum in the fixed unit has its own collection tank, fan, motor, and exhaust port. In a non-limiting alternative embodiment, the vacuum is connected by tubing to the mobile unit for the recovery of waste solution and/or debris from the target area during retraction of the mobile unit to the fixed unit. The timing of the vacuum is controlled by the controller. The vacuum collection tank is connected by tubing to the recovery tank or an external drain.

The recovery tank is designed to receive the waste solution and/or debris collected by the vacuum. The recovery tank can be removable from the fixed unit for emptying and replacement into the fixed unit. In an alternative non-limiting embodiment, the recovery tank is removable for disposable and replaced with a new recovery tank. In another alternative non-limiting embodiment, the recovery tank is disposable and contains absorbent material/particles. In another alternative non-limiting embodiment, the recovery tank is external to the fixed unit and connected by tubing to the fixed unit. In another alternative non-limiting embodiment, the recovery tank is connected to an external drain or replaced by tubing directly to the external drain. Optionally, a window or other indicator is provided on the exterior of the fixed unit and the recovery tank so that the level of waste solution is visible or otherwise indicated.

In alternative non-limiting embodiments of the present invention, the fixed unit has one or more top opening lids for access to all or some of the internal components, such as the disinfectant solution tank, the recovery tank, and/or optional battery. In other non-limiting embodiments of the present invention, the fixed unit has front access ports for access to all or some of the internal components, such as the disinfectant solution tank, the recovery tank, and/or optional battery. In other non-limiting embodiments of the present invention, the internal components of the cleaning and recovery unit are accessed by a panel on the urinal, toilet, sink, or hand drying device.

The mobile unit comprises spray port(s) for spraying disinfectant solution onto the target area and a scrapping implement, like one or more squeegee, for contacting the target area of floor and collecting the waste solution and/or debris from the target area upon retraction of the mobile unit to the fixed unit. In other non-limiting embodiments of the invention, the mobile unit also contains recovery vacuum port(s) for suctioning waste solution and/or debris from the target area during retraction of the mobile unit to the fixed unit. In other non-limiting embodiments of the invention, the mobile unit also contains a brush wherein the brush is either fixed or moves by rotating or spinning. In other non-limiting embodiments of the invention, the mobile unit sprays disinfectant solution onto the target area upon extension of the mobile unit from the fixed unit. In other non-limiting embodiments of the invention, the scrapping implement contacts the target area of the floor upon extension of the mobile unit thereby pushing the waste solution and/or debris from the target area to a floor drain or floor-mounted urinal drain basin.

The vacuum ports may be located on the bottom of the mobile unit at positions proximal to the fixed unit and distal to the scrapping implement, and/or distal to the fixed unit and proximal to the scrapping implement depending on the design.

The disinfectant solution spray ports may be located on the bottom of the mobile unit at positions distal to the fixed unit and proximal to the scrapping implement, and/or proximal to the fixed unit and distal to the scrapping implement depending on the design.

The scrapping implement preferably has two arcs of squeegee to enhance the capture capability of the mobile unit. The arcs may be convex or concave depending on the design.

The extension mechanism is powered by the motor housed in the fixed unit. According to a non-limiting embodiment of the invention, upon activation by the controller, the extension mechanism first lifts and then extends the mobile unit. Upon initiation of the extension of the mobile unit, the controller then activates the spraying of disinfectant solution over the target area. The extension mechanism supports, either internally or externally, the disinfectant solution tubing that connects the disinfectant solution tank to the mobile unit disinfectant port(s). In alternative non-limiting embodiments of the invention, the extension mechanism also supports, either internally or externally, the vacuum tubing that connects the vacuum collection tank to the recovery port(s) on the mobile unit. Upon retraction of the mobile unit, the extension mechanism first drops and then retracts the mobile unit.

In another alternative non-limiting embodiment of the invention, the mobile unit is extended from the fixed unit by the extension mechanism in a raised position and when fully extended the extension mechanism drops the mobile unit into a lowered position to contact the surface of the floor. The scrapping elements of the mobile unit are in contact with the floor as the mobile unit is retracted back to the fixed unit.

In another alternative non-limiting embodiment of the invention, the mobile unit has one or more wheels that support the mobile unit and roll on the floor during the extension and retraction of the mobile unit. In alternative non-limiting embodiments of the invention, the mobile unit has at least two wheels. In further alternative non-limiting embodiments of the invention, the mobile unit has two forward wheels distal to the fixed unit and two rearward wheels proximal to the fixed unit. In further alternative non-limiting embodiments of the invention, the forward wheels are raised on extension of the mobile unit, which pivots the mobile unit upward so that it does not contact the floor on extension, and lowered on retraction of the mobile unit, which pivots the mobile unit downward to come in contact with the floor on retraction. In other alternative non-limiting embodiments of the invention, the forward wheels and rearward wheels are in contact with the floor on extension of the mobile unit. Then the rearward wheels are raised to bring the scrapping elements of the mobile unit in contact with the floor on retraction. In other alternative non-limiting embodiments of the invention, the forward wheels are raised on extension of the mobile unit and the rearward wheels are raised on retraction of the mobile unit in order to keep the scrapping elements above the surface of the floor on extension of the mobile unit and to bring the scrapping elements in contact with the surface of the floor on retraction of the mobile unit.

In another example embodiment of the present invention, an automatic floor cleaning unit in accordance with the present invention is mounted to the floor adjacent to a traditional floor-mounted urinal. The cleaning unit comprises a fixed unit, a mobile unit, and an extension mechanism connected to the fixed unit and the mobile unit to permit the extension and retraction of the mobile unit from and to the fixed unit. The fixed unit comprises a controller, a sensor, a motor, a power source, and a disinfectant solution tank. In this example embodiment of the present invention, the cleaning unit does not contain a vacuum or recovery tank because it takes advantage of the floor-mounted urinal for disposal of waste solution and/or debris.

The extension mechanism has an angle arm that both extends and rotates the mobile unit relative to the fixed unit in order to clean a path in the direction of the floor-mounted urinal drain basin.

In another alternative non-limiting embodiment of the invention, the fixed unit is not mounted to a floor or wall but is integrated into the design of a urinal, toilet, sink, or hand drying unit. In another alternative non-limiting embodiment of the invention, the fixed unit is housed within the urinal, toilet, sink, or hand drying unit.

In another alternative non-limiting embodiment of the invention, the disinfectant solution tank is not housed inside the fixed unit but is wall-mounted next to and connected to the fixed unit, for example, by tubing.

In another alternative non-limiting embodiment of the invention, the automatic floor cleaning and recovery unit is permanently or temporarily mounted adjacent to a urinal, toilet, sink, or hand drying unit so that the entire unit can be removed, discarded, and/or replaced.

In alternative non-limiting embodiments of the invention, the external design of the fixed unit may be stylized to match the decor of the restroom in color, size and overall shape.

In a non-limiting alternative embodiment of the invention, the controller and sensor may be set to extend the mobile unit each time the sensor is triggered. In other alternative non-limiting embodiments of the invention, the mobile unit is extended on an intermittent basis. For example, the mobile unit would extend after every other time the sensor is triggered. In other alternative non-limiting embodiments of the invention, the mobile unit is extended only when the sensor is triggered during certain predetermined time periods. For example, the controller may be set to permit the extension of the mobile unit at 10 minute intervals for windows of 5 minutes during which time the mobile unit would be extended if the sensor is triggered at any predetermined frequency (such as every time, or every other time). During the 10 minute interval, the mobile unit would not extend despite the triggering of the sensor. In other alternative non-limiting embodiments of the invention, the mobile unit is extended after a period of delay so that the mobile unit would extend only after a certain number of minutes of non-use after the sensor is last triggered. In other alternative non-limiting embodiments of the invention, the mobile unit is extended at predetermined times (such as every two hours, or at particular times) without the need for triggering any sensor. It may be preferable in restrooms with low usage to activate the device on a daily basis, for example, despite the non-usage of a particular urinal. Further, in high usage locations, like stadium restrooms, it may be preferable to activate the device on a delay, instead of after each user, between the high usage time periods.

Referring to the Figures, FIG. 1 illustrates an automatic floor cleaning and recovery unit 100 in accordance with the present invention that is floor-mounted with a bracket 114 under a wall-mounted urinal 20. The automatic floor cleaning and recovery unit 100 has a fixed unit 110, a sensor 112 on the fixed unit 110 and a mobile unit 130 retracted into the fixed unit. The sensor is mounted with a line of view in the direction of the target area 10 of floor to be cleaned by the mobile unit 130 upon extension and retraction from the fixed unit 110.

Figure 2:
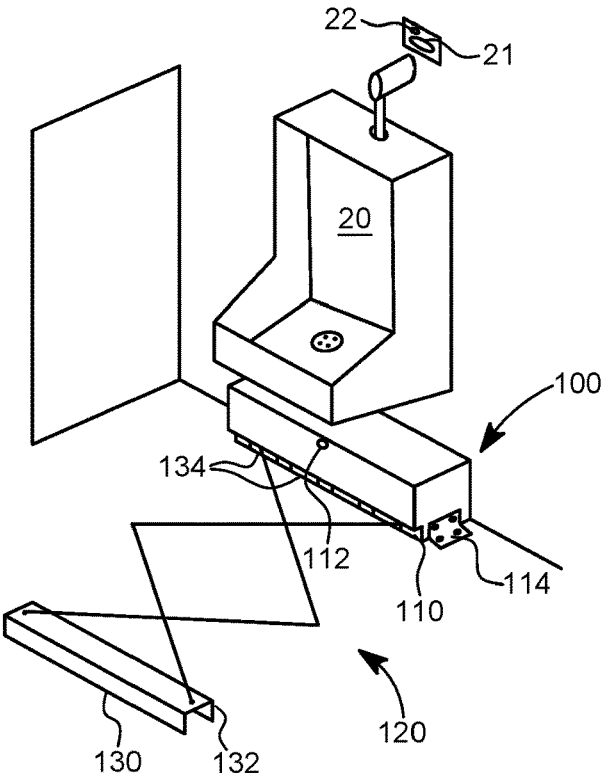
FIG. 2 is a perspective view of the device of FIG. 1 wherein the mobile unit is in an extended position.

FIG. 2 illustrates a perspective view of the automatic floor cleaning and recovery unit 100 of FIG. 1 with the mobile unit 130 extended by extension mechanism 120. On retraction, the extension mechanism 120 drops the mobile unit 130 so that scrapping implement 132 comes in contact with the floor. In this embodiment of the invention, the disinfectant solution tubing resides inside the extension mechanism. Upon retraction of the mobile unit 130, waste solution is recovered by the vacuum ports 134.

Figure 3:
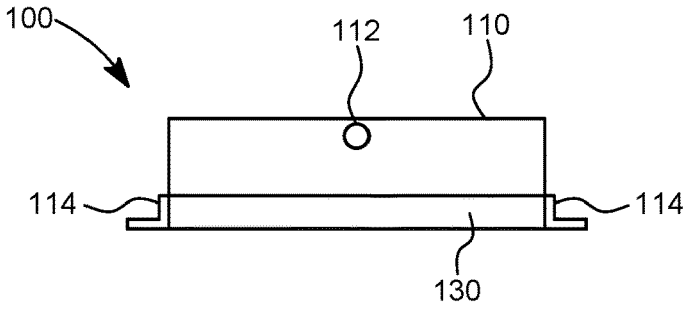
FIG. 3 is a front view of the device shown in FIG. 1.
Figure 4:
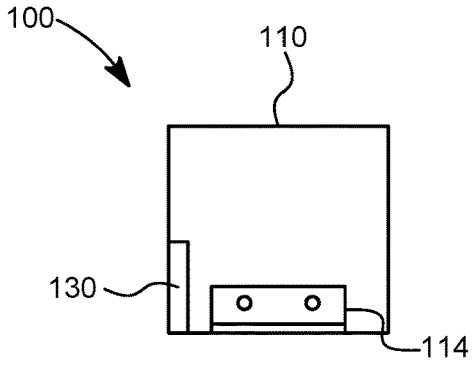
FIG. 4 is a side view of the device shown in FIG. 1.
Figure 5:
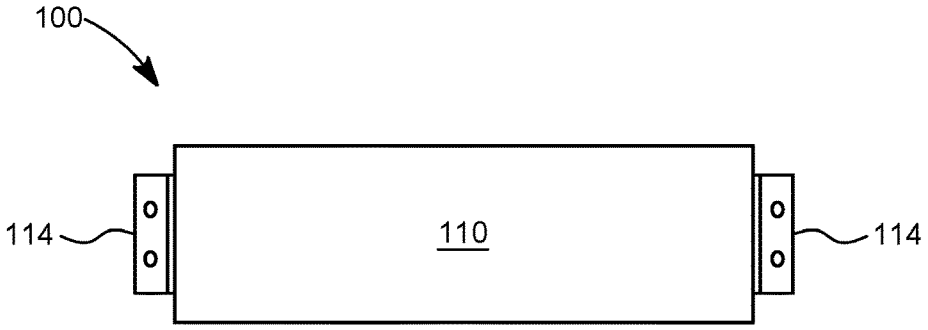
FIG. 5 is a top view of the device shown in FIG. 1.

FIGS. 3-5 illustrate front, side, and top views of the automatic floor cleaning and recovery unit 100 of FIG. 1. The overall shape of the fixed unit 110 is illustrated as generally rectangular in shape, but can be designed in a variety of shapes. The mobile unit 130 of the automatic floor and recovery unit 100, in this embodiment of the invention, is designed to reside inside the fixed unit when fully retracted. However, in other alternative non-limiting embodiments of the invention, the mobile unit 130 may reside adjacent to the fixed unit 110. The automatic floor cleaning and recovery unit 100 is floor-mounted, in this non-limiting embodiment of the invention, using bracket 114. Screws or bolts may be used to permanently mount the unit 100 to the floor, wall, or lavatory appliance. Alternatively, the unit 100 may be temporarily mounted to the floor or wall using suction cups or other temporary mounting hardware.

Figure 6:
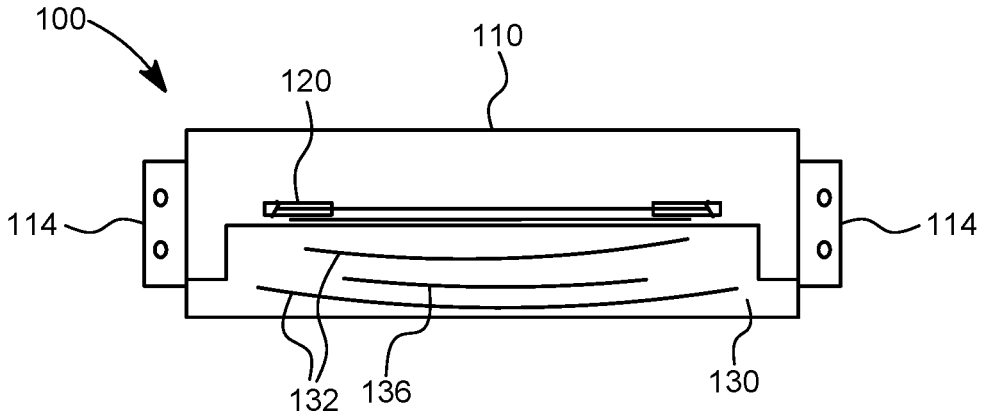
FIG. 6 is a bottom view of the device shown in FIG. 1.
Figure 7:
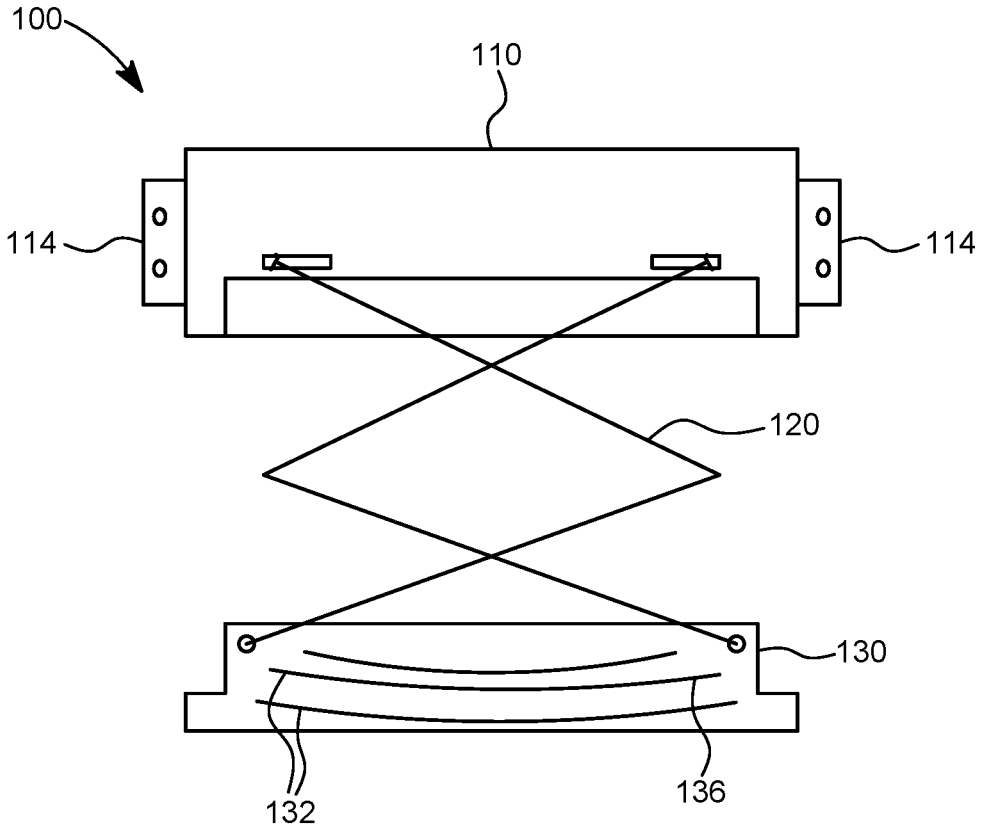
FIG. 7 is a bottom view of the device shown in FIG. 2.
Figure 8:
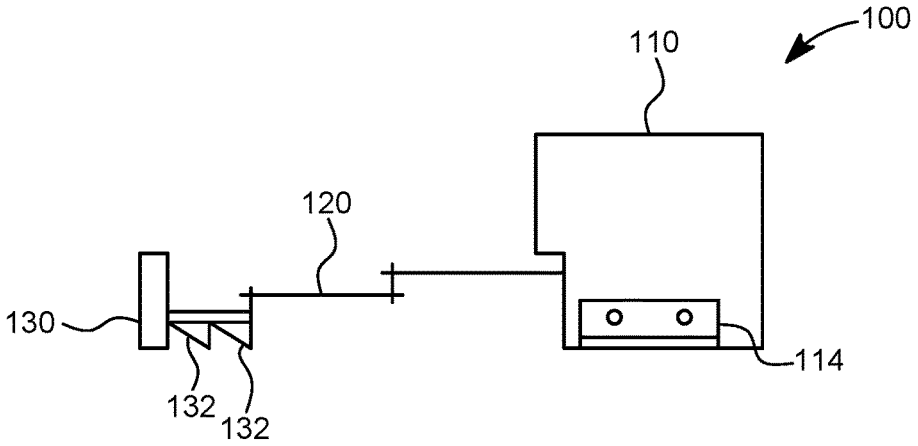
FIG. 8 is a side view of the device shown in FIG. 2.

FIGS. 6-8 illustrate the automatic floor cleaning and recovery unit 100 of FIG. 1 when the mobile unit 130 is in a retracted position (FIG. 6) and in an extended position (FIGS. 7-8). In this embodiment of the invention, the mobile unit 130 has two scrapping elements 132 and a band of disinfectant solution spray ports 136 between the two scrapping elements 132.

Figure 9A:
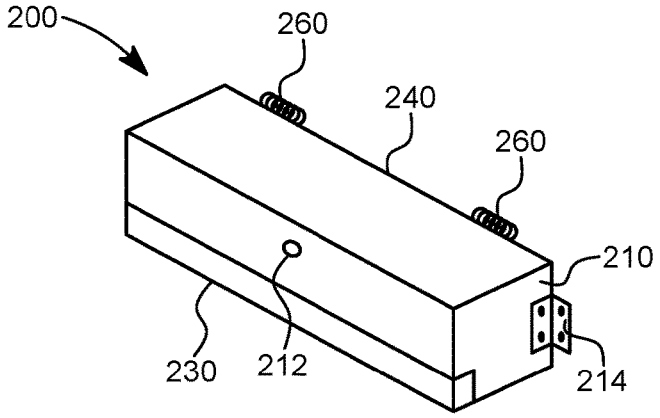
FIG. 9A is a perspective view of an embodiment of the present invention wherein the fixed unit is wall mounted and has a single top opening lid for access to the disinfectant solution tank and the recovery tank.
Figure 9B:
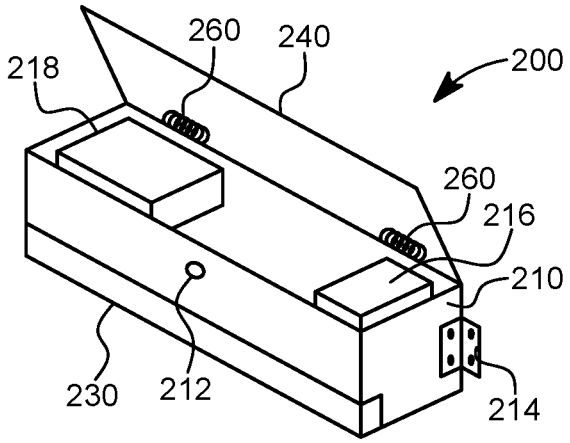
FIG. 9B is a perspective view of the device shown in FIG. 9A showing the top opening lid in an open position.
Figure 9C:
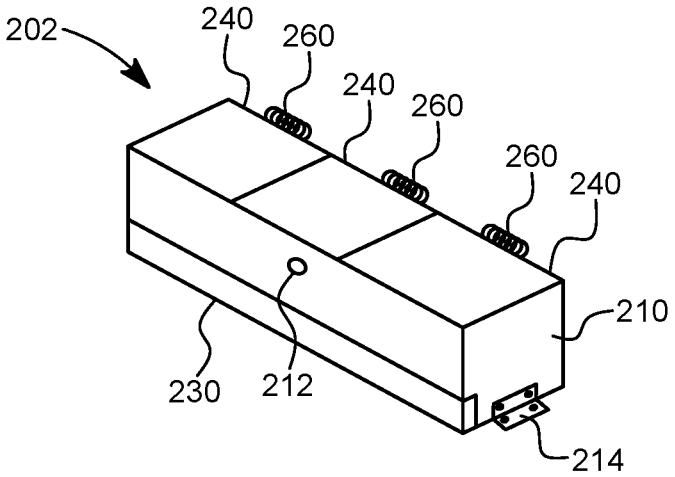
FIG. 9C is a perspective view of a device according to another non-limiting embodiment of the present invention wherein the fixed unit is floor-mounted and has separate top opening lids for access to particular internal components.
Figure 9D:
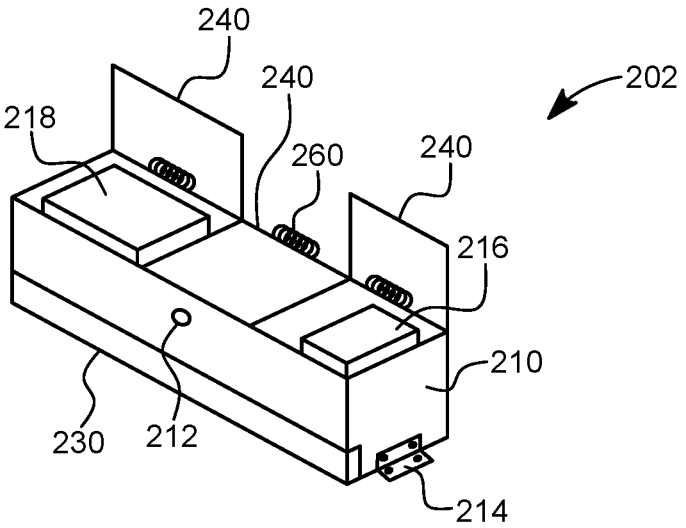
FIG. 9D is a perspective view of the device shown in FIG. 9C showing two of the three top opening lids in open positions.

FIG. 9A is an alternative non-limiting embodiment of the invention having a top opening lid 240 for access to the internal mechanisms of the fixed unit 210 of the cleaning and recovery unit 200. In this embodiment, the lid 240 is attached to the fixed unit 210 by a pair of hinges 260. FIG. 9B illustrates the top opening lid 240 in an open position for access to the disinfectant solution tank 218 and recovery tank 216. The lid 240 may optionally have a lock (not illustrated) to permit access to the internal mechanisms of the fixed unit 210 only by authorized personnel. FIG. 9C illustrates another alternative embodiment of the invention having separate top opening lids 240 for access to particular internal components of the cleaning and recovery unit 202. In this embodiment, each lid 240 has its own hinge 260. Each lid 260 may have its own lock (not illustrated). Having lids with separate locks would provide for limited or no access to certain internal compartments of the cleaning and recovery unit. For example, as illustrated in FIG. 9D, during ordinary maintenance of the unit 202 access may be available to replace the disinfectant solution tank 218 and recovery tank 216 but not to replace an internal battery, for example, which would be accessible to the bearer of a separate key.

Figure 10A:
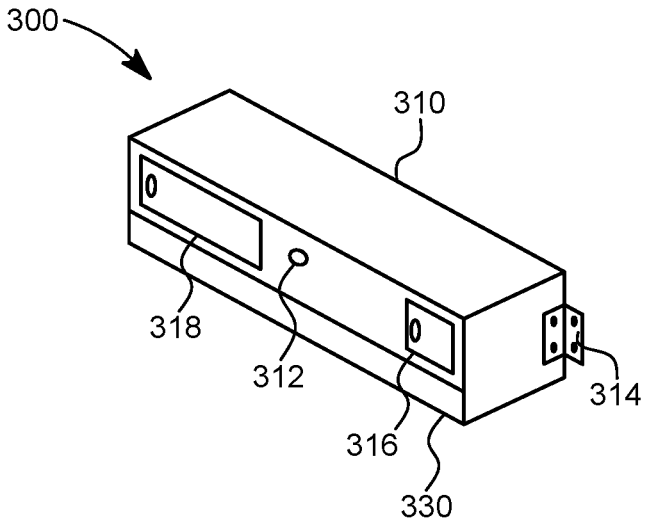
FIG. 10A is a perspective view of a device according to another non-limiting embodiment of the present invention that is wall-mounted wherein the fixed unit has ports for front access to insert and remove internal components, specifically in this illustration the disinfectant solution tank and the recovery tank.
Figure 10B:
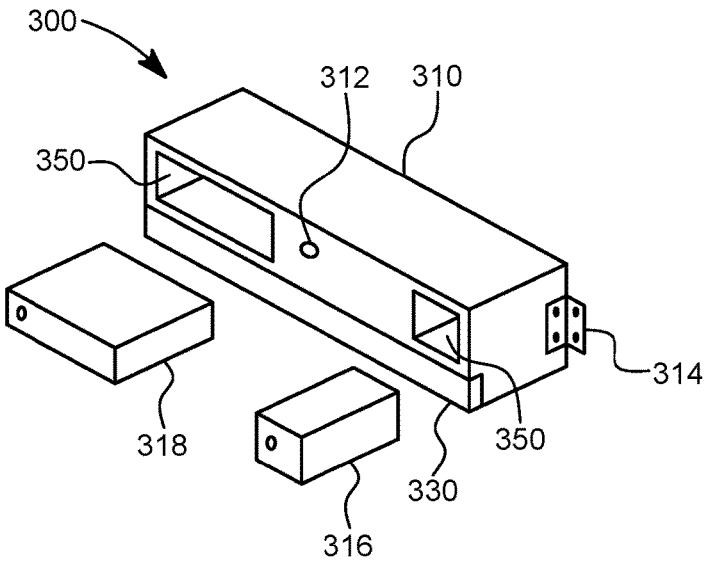
FIG. 10B is a perspective view of the device shown in FIG. 10A showing the disinfectant solution tank and the recovery tank removed from the fixed unit.

FIGS. 10A-10B illustrate another alternative non-limiting embodiment of the invention whereby the fixed unit 310 of the cleaning and recovery unit 300 has ports 350 for front access to insert and remove internal components, such as the disinfectant solution tank 318 and recovery tank 316. The disinfectant solution tank and recovery tank are shown with windows to see the level of solution within each tank.

Figure 11A:
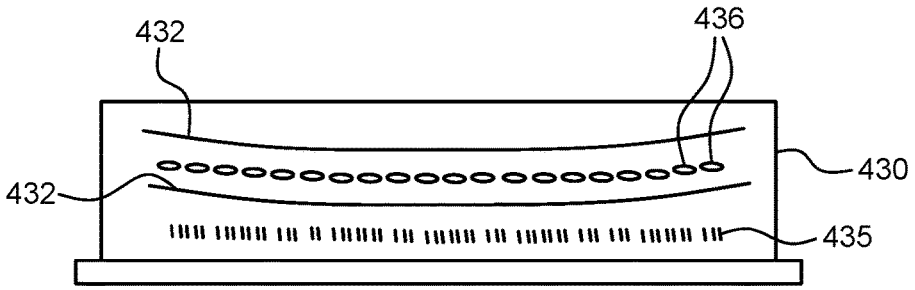
FIG. 11A to FIG. 11C are bottom views of the mobile unit according to other non-limiting embodiments of the present invention.
Figure 11B:
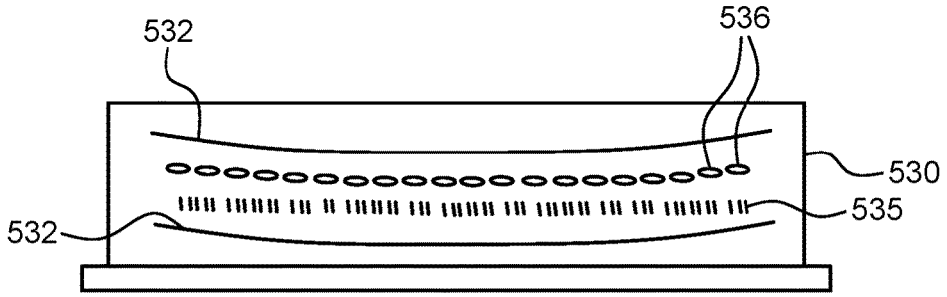
Figure 11C:
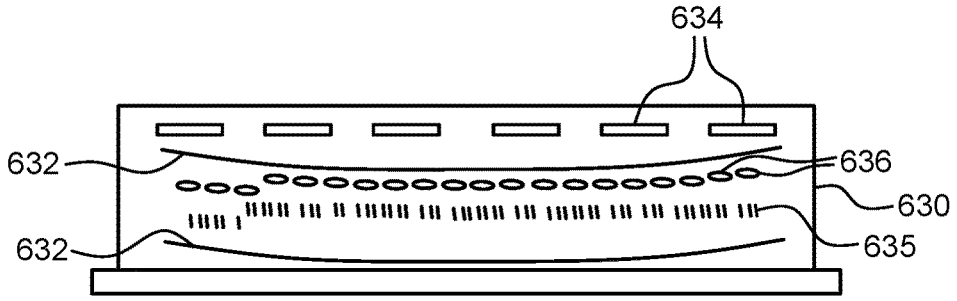

FIGS. 11A-11C illustrate bottom views of the mobile units 430, 530, and 630 in accordance with alternative non-limiting embodiments of the invention. In the bottom view of the alternative non-limiting embodiment of the mobile unit 430 in FIG. 11A, two scrapping elements 432 are provided. These scrapping elements are preferably shaped in an arc to assist in the recovery of waste solution as the mobile unit 430 is retracted to the fixed unit. In between the two scrapping elements 432 is a band of disinfectant solution spray ports 436. In addition, in this non-limiting embodiment of the invention, the mobile unit 430 also has a brush 435 to assist in the removal of debris.

In the bottom view of the alternative non-limiting embodiment of the mobile unit 530 in FIG. 11B, two scrapping elements 532 are provided. Both scrapping elements 532 are preferably shaped in an arc to assist in the recovery of waste solution as the mobile unit 530 is retracted to the fixed unit. In between the two scrapping elements 532 are a band of disinfectant solution spray ports 536 and a brush 535.

In the bottom view of the alternative non-limiting embodiment of the mobile unit 630 in FIG. 11C, two scrapping elements 632 are provided. Both scrapping elements 632 are preferably shaped in an arc to assist in the recovery of waste solution as the mobile unit 630 is retracted to the fixed unit. In between the two scrapping elements 632 are a band of disinfectant solution spray ports 636 and a brush 635. In addition, the mobile unit 630 has a band of vacuum ports 634 for suctioning waste solution. The suctioning of waste solution through vacuum ports 634 can occur during extension of the mobile unit 630, during retraction of the mobile unit 630, or during extension and retraction of the mobile unit 630. These vacuum ports 634 on the mobile unit 630 can function in addition to or instead of the vacuum ports on the fixed unit. The vacuum ports 634 on the mobile unit 630 would be connected by tubing to the fixed unit.

Figure 12:
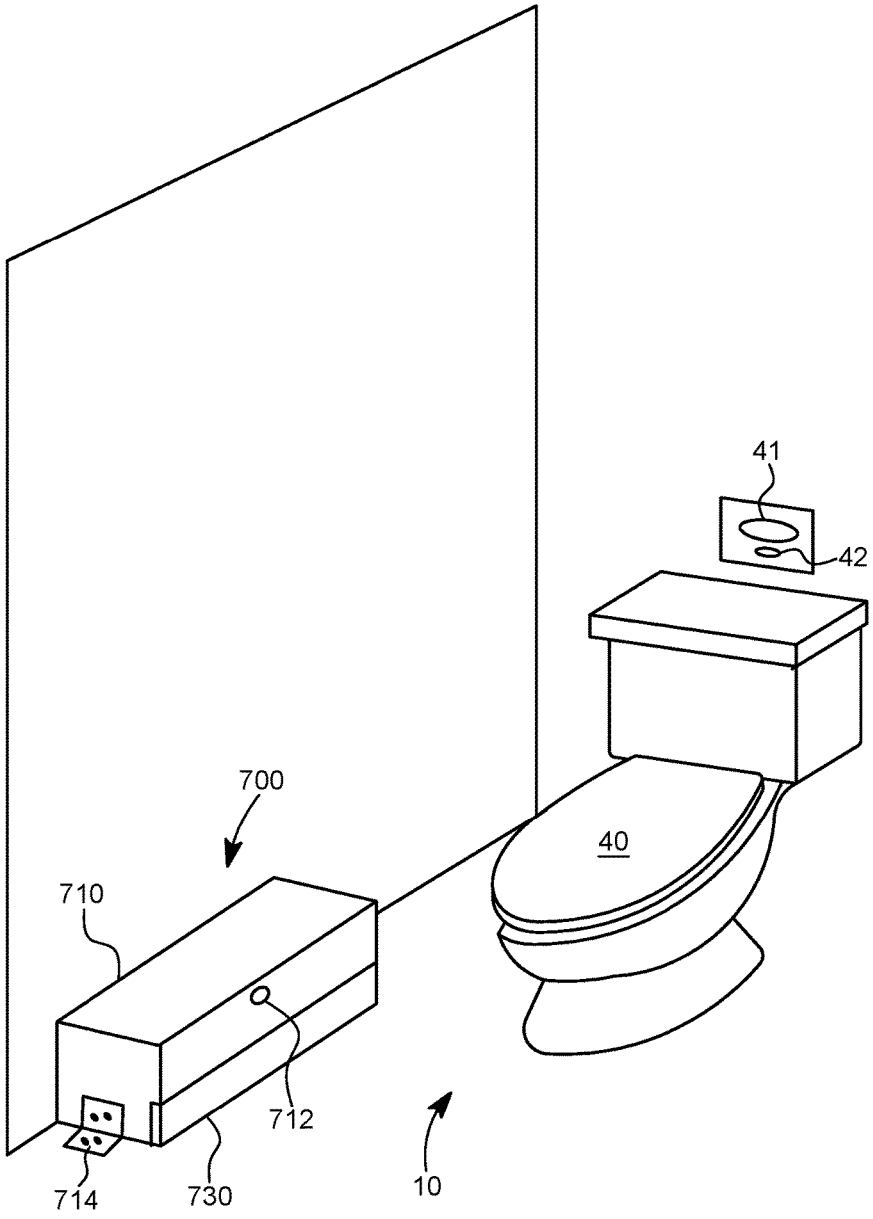
FIG. 12 is a perspective view of a device according to another non-limiting embodiment of the present invention that is floor-mounted adjacent to a floor-mounted toilet.
Figure 13:
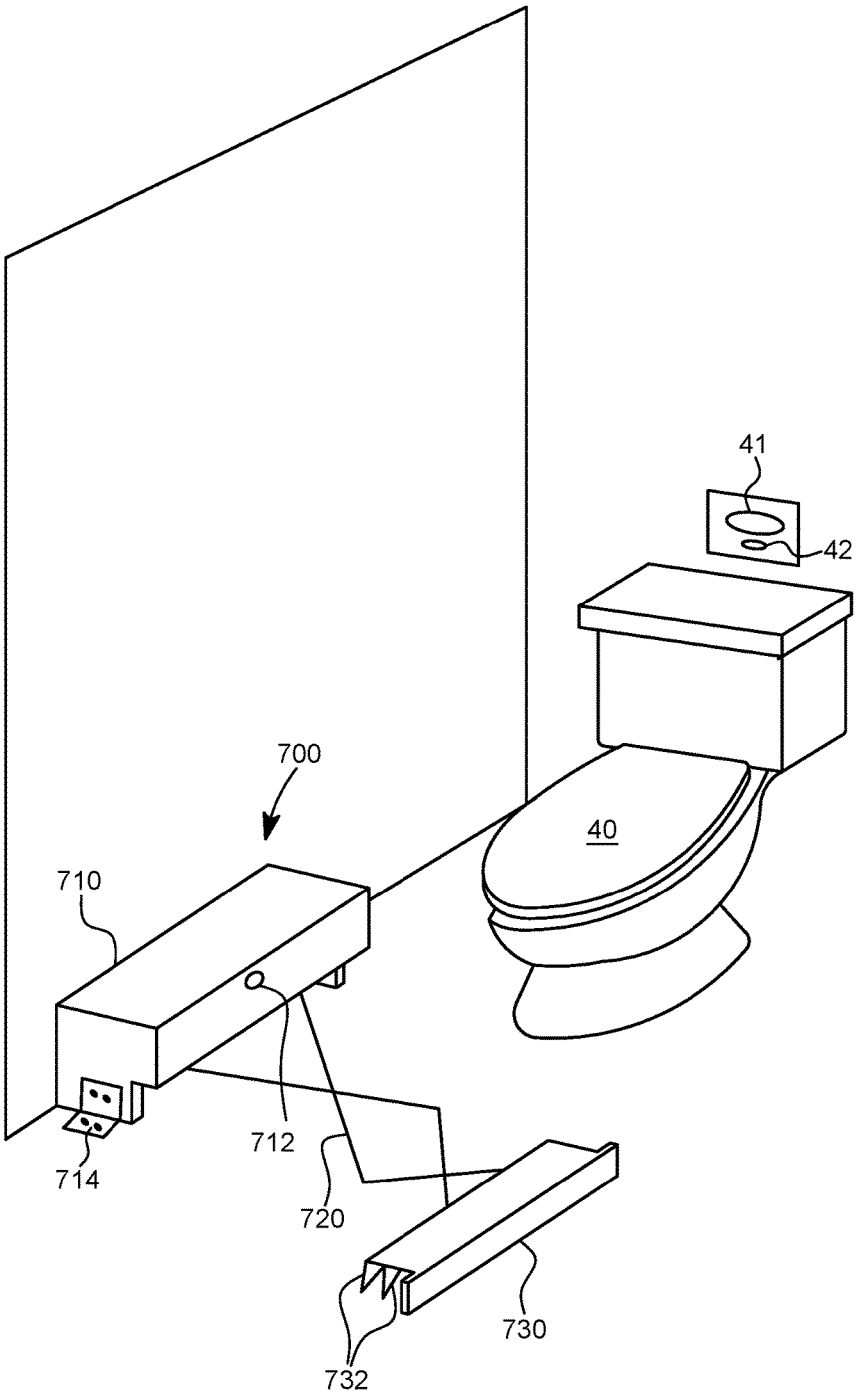
FIG. 13 is a perspective view of the device of FIG. 12 wherein the mobile unit is in an extended position.

As illustrated in FIG. 12, an automatic floor cleaning and recovery unit 700 can be floor-mounted adjacent to a floor-mounted toilet 40 with a wall-mounted flush sensor 41 and manual flush 42. The floor cleaning and recovery unit 700 can also be floor-mounted or wall-mount adjacent to a wall or floor-mounted sink as well as a wall or floor-mounted hand drying machine. In FIG. 12, the fixed unit 710 is permanently mounted to the floor with bracket 714. The fixed unit 710 may also be temporarily wall or floor-mounted using suction cups or other temporary mounting hardware. FIG. 13 illustrates the floor cleaning and recovery unit of FIG. 12 in an extended position.

Figure 14:
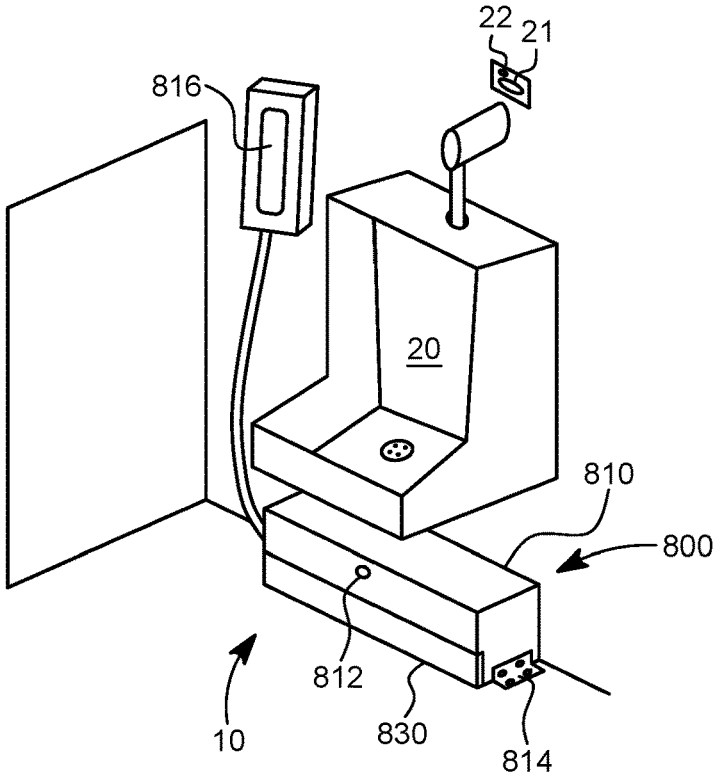
FIG. 14 is a perspective view of a device according to another non-limiting embodiment of the present invention wherein the disinfectant solution tank is housed in a wall-mounted unit separate from the fixed unit but connected by tubing to the fixed unit.

FIG. 14 illustrates another non-limiting embodiment of the present invention. The automatic floor cleaning and recovery unit 800 is floor-mounted adjacent to a wall-mounted urinal 20 having a wall-mounted flush sensor 21 and manual flush 22, wherein the disinfectant solution tank 816 is separately wall-mounted and connected by tubing to the fixed unit 810. This design is particularly advantageous when the fixed unit 810 is connected to an external drain (not illustrated).

Figure 15:
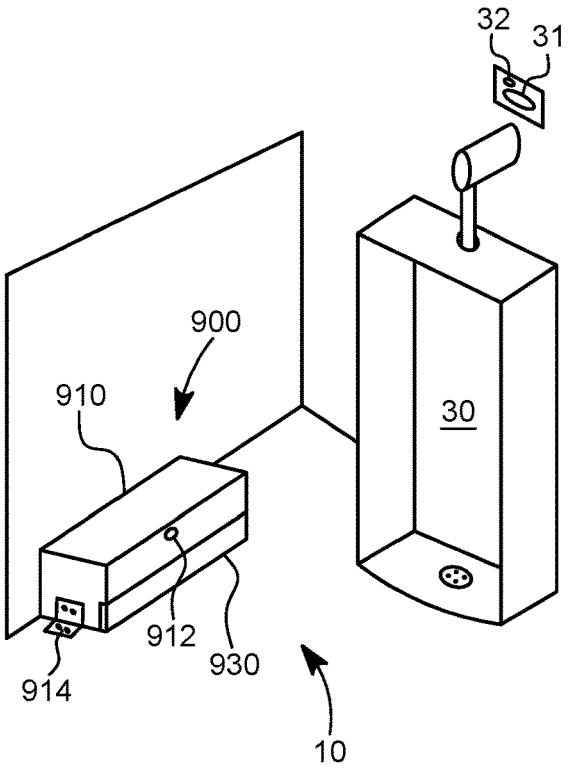
FIG. 15 is a perspective view of a device according to another embodiment of the present invention that is floor-mounted adjacent to a floor-mounted urinal and does not require a vacuum or recovery tank.
Figure 17:
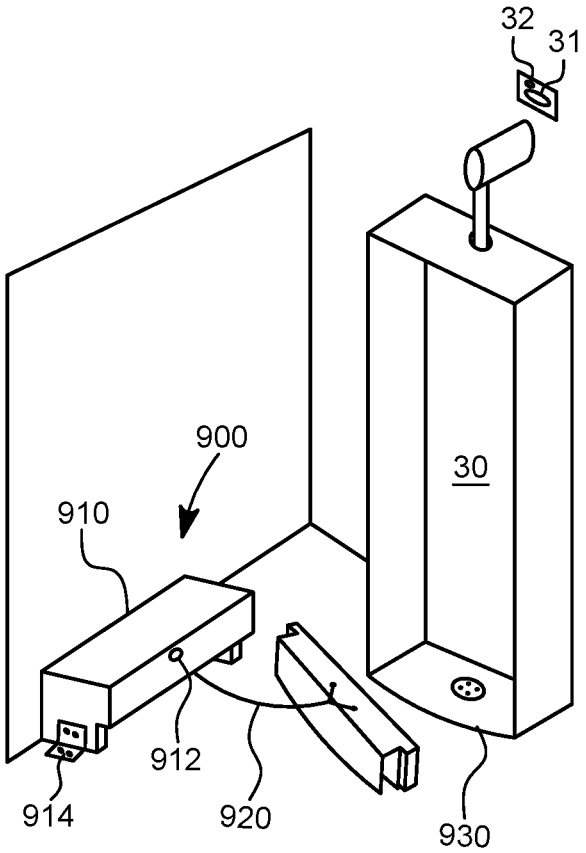
FIG. 17 is a perspective view of the device of FIG. 15 wherein the mobile unit is in an extended position.

FIG. 15 is an illustration of another alternative non-limiting embodiment of the present invention that does not require a vacuum or recovery tank. The automatic floor cleaner 900 is floor-mounted using bracket 914 so that the fixed unit 910 is adjacent to a floor-mounted urinal 30. The extension mechanism 920 extends the mobile unit 930, as shown in an extended position in FIG. 17, from the fixed unit 910 in a direction towards the floor-mounted urinal 30 drain basin. In this embodiment, the fixed unit 910 does not require a vacuum or recovery tank because the waste solution is directed to the external drain. In this design, the mobile unit 930 is preferably modified to push instead of pull the waste solution.

Figure 16A:
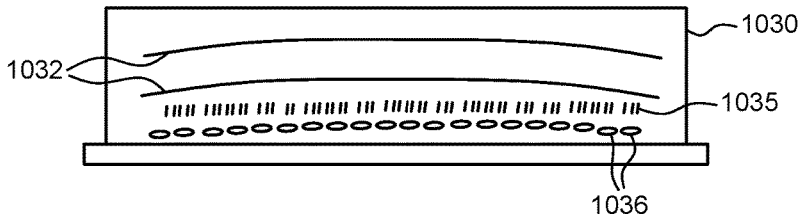
FIG. 16A to FIG. 16C are bottom views of the mobile unit according to other non-limiting embodiments of the present invention.
Figure 16B:
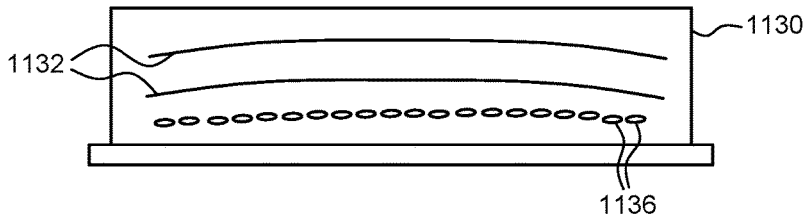
Figure 16C:
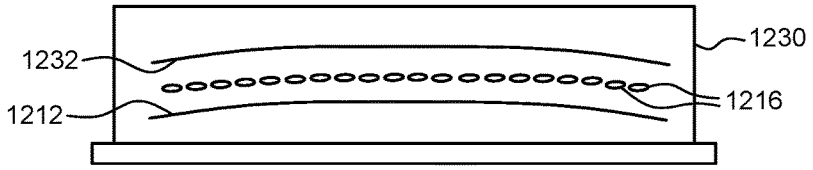

FIGS. 16A-16C illustrate alternative non-limiting embodiments of mobile units 1030, 1130, 1230 of the present invention, wherein the mobile units are design to push instead of pull the waste solution. FIG. 16A illustrates a bottom view of mobile unit 1030 having two scrapping units 1032, a brush 1035, and a band of disinfectant solution spray ports 1036. The arc of each scrapping unit 1032 assists in the disposal of waste solution. FIG. 16B illustrates an alternative non-limiting embodiment of the invention wherein mobile unit 1130 has two scrapping units 1132 and a band of disinfectant solution spray ports 1136. FIG. 16C illustrates a bottom view of a mobile unit 1230 having tow scrapping units 1232 and a band of disinfectant solution spray ports 1216 in between the scrapping elements 1232.

Figure 18:
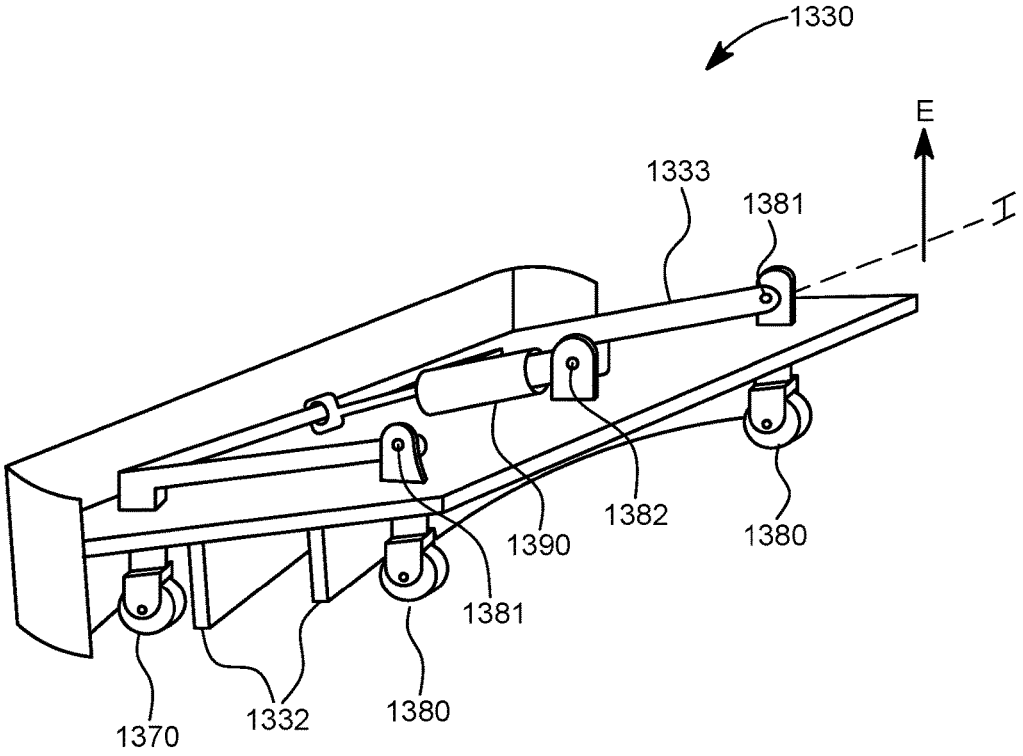
FIG. 18 is a perspective view of a mobile unit according to another non-limiting embodiment of the present invention.

FIG. 18 illustrates another alternative non-limiting embodiment of the invention. The mobile unit 1330 in FIG. 18 has two forward wheels 1370 and two rearward wheels 1380. The forward wheels 1370 are distal to the fixed unit (not shown) and the rearward wheels 1380 are proximal to the fixed unit (not shown). Between the forward wheels 1370 and the rearward wheels 1380 are two scrapping elements 1332. Not shown in FIG. 18 are disinfectant solution ports and tubing, engagement with the extension mechanism, optional brush, and optional vacuum ports and tubing. In this alternative embodiment, mobile unit 1330 rolls on all four wheels during extension of the mobile unit 1330 from the fixed unit (not shown). Upon activation of the linear actuator 1390, the rearward wheels are lifted from contact with the floor and the scrapping elements 1332 are pressed to the floor upon retraction of the mobile unit to the fixed unit. When the mobile unit 1330 is fully extended, then linear actuator 1390 is activated to raise the proximal portion of the mobile unit and to lower the distal portion of the mobile unit. In this way, the scrapping elements 1332 do not come in contact with the floor upon extension of the mobile unit 1330 from the fixed unit but do contact the floor upon retraction of the mobile unit 1330 to the fixed unit. In this embodiment, the forward wheels 1370 and the rearward wheels 1380 are connected by a frame 1333. The frame 1333 is directly and fixedly connected to the forward wheels 1370. The frame 1333 is pivotally connected to the rearward wheels by pins 1381. The linear actuator 1390 is directly and fixedly connected to the forward wheels 1370 and is pivotally connected to the mobile unit by pivot pin 1382. The pivot pin 1382 of the linear actuator 1390 may be in the same line of axis I formed between pins 1381, but preferably is slightly elevated E above the line of axis I between the pins 1381. Upon actuation of linear actuator 1390, the rearward wheels 1380 are elevated upward in the direction E.

Figure 19:
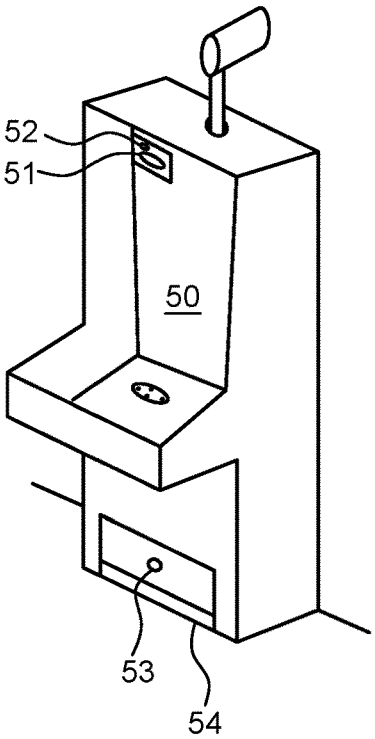
FIG. 19 is a perspective view of a device according to another non-limiting embodiment of the present invention illustrating a fixed unit housed within a wall-mounted urinal.

FIG. 19 illustrates another non-limiting embodiment of the present invention. The automatic floor cleaning and recovery unit is housed within wall-mounted urinal 50. In this embodiment, the cleaning and recovery unit uses its own sensor 53 to activate the extension of mobile unit 54 and wall-mounted urinal 50 uses its own integrated flush sensor 51 and manual flush 52.

Figure 20:
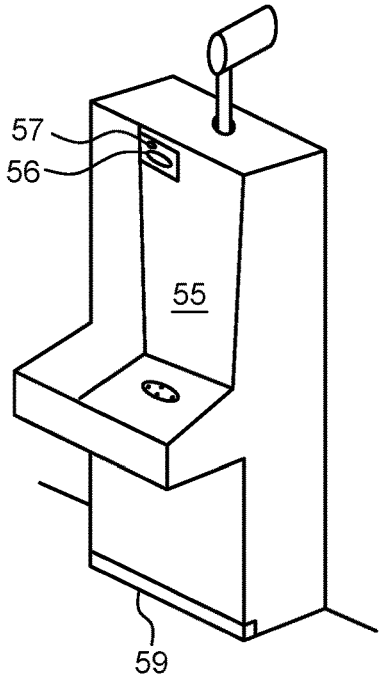
FIG. 20 is a perspective view of a device according to another non-limiting embodiment of the present invention illustrating a fixed unit integrated into a wall-mounted urinal.

FIG. 20 illustrates another non-limiting embodiment of the present invention. In this embodiment, the automatic floor cleaning and recovery unit is integrated into wall-mounted urinal 55. The cleaning and recovery unit in this embodiment utilizes the wall-mounted urinal's flush sensor 56 and manual flush 57 to activate the extension of mobile unit 59.

Figure 21:
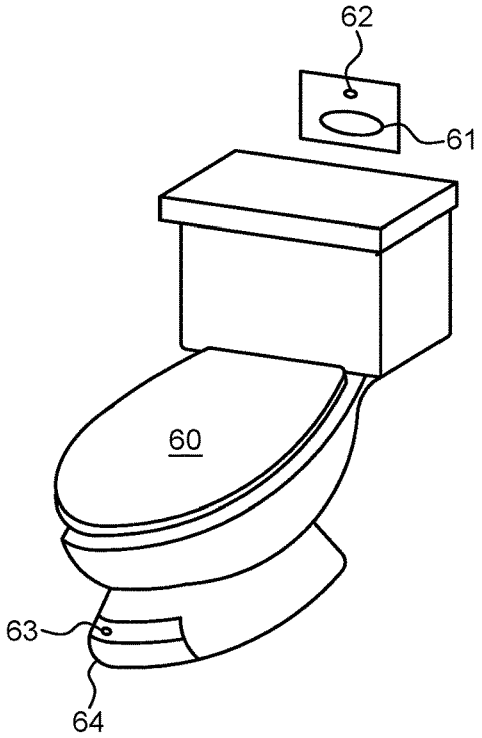
FIG. 21 is a perspective view of a device according to another non-limiting embodiment of the present invention illustrating a fixed unit housed within a floor-mounted toilet.

FIG. 21 illustrates another non-limiting embodiment of the present invention. The automatic floor cleaning and recovery unit is housed within a floor-mounted toilet 60. In this embodiment, the cleaning and recovery unit uses its own sensor 63 to activate the extension of mobile unit 64 and floor-mounted toilet 60 uses its own wall-mounted flush sensor 61 and manual flush 62.

Figure 22:
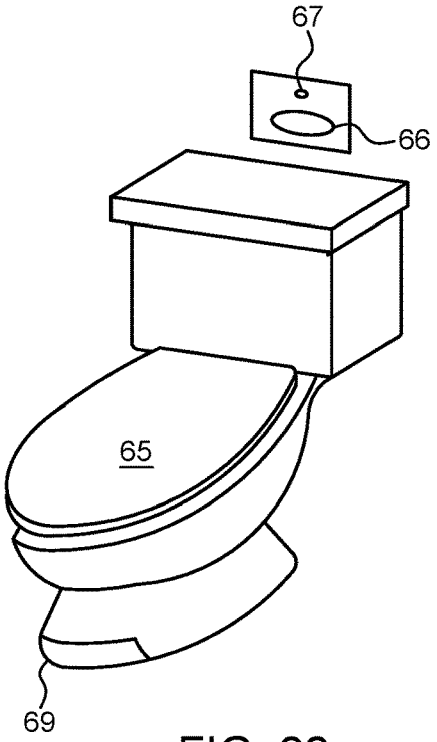
FIG. 22 is a perspective view of a device according to another non-limiting embodiment of the present invention illustrating a fixed unit integrated into a floor-mounted toilet.

FIG. 22 illustrates another non-limiting embodiment of the present invention. In this embodiment, the automatic floor cleaning and recovery unit is integrated into floor-mounted toilet 65. The cleaning and recovery unit in this embodiment utilizes the floor-mounted toilet's flush sensor 66 and manual flush 67 to activate the extension of mobile unit 69.

Figure 23:
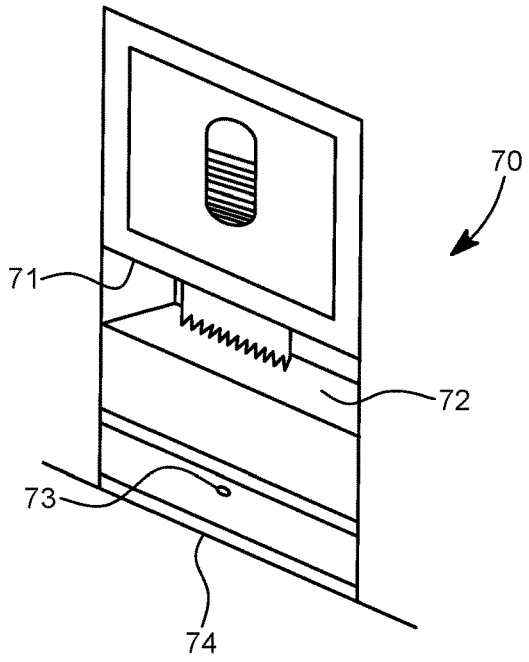
FIG. 23 is a perspective view of a device according to another non-limiting embodiment of the present invention illustrating a fixed unit housed within a wall-mounted, paper-dispensing, hand drying device.

FIG. 23 illustrates another non-limiting embodiment of the present invention. The automatic floor cleaning and recovery unit is housed within a wall-mounted, paper-dispensing, hand drying device 70. In this embodiment, the cleaning and recovery unit uses its own sensor 73 to activate the extension of mobile unit 74. The wall-mounted, paper-dispensing, hand drying device has no sensor associated with its paper dispenser 71 and trash container 72.

Figure 24:
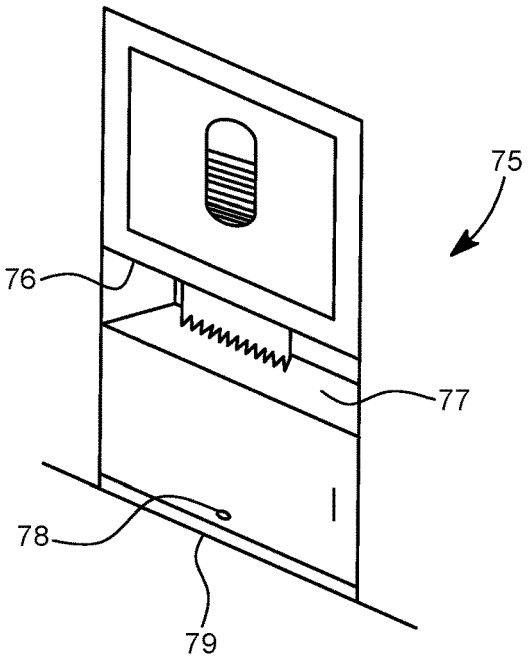
FIG. 24 is a perspective view of a device according to another non-limiting embodiment of the present invention illustrating a fixed unit integrated into a wall-mounted, paper-dispensing, hand drying device.

FIG. 24 illustrates another non-limiting embodiment of the present invention. In this embodiment, the automatic floor cleaning and recovery unit is integrated into wall-mounted, paper-dispensing, hand drying device 75. The mobile unit 79, in this embodiment, is activated by sensor 78, which is mounted on hand drying device 75. The wall-mounted, paper-dispensing, hand drying device 75 has no sensor associated with its paper dispenser 76 and trash container 77.

Figure 25:
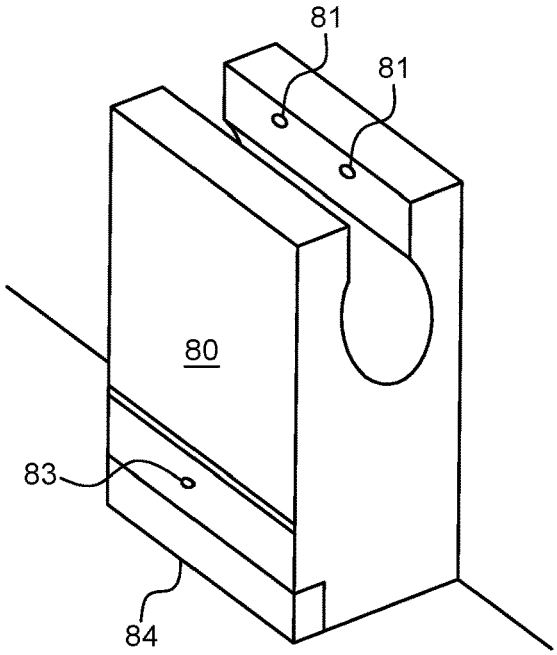
FIG. 25 is a perspective view of a device according to another non-limiting embodiment of the present invention illustrating a fixed unit housed within a wall-mounted, forced-air, hand drying device.

FIG. 25 illustrates another non-limiting embodiment of the present invention. The automatic floor cleaning and recovery unit is housed within a wall-mounted, forced-air, hand drying device 80. In this embodiment, the cleaning and recovery unit uses its own sensor 83 to activate the extension of mobile unit 84 independent of the wall-mounted, forced-air, hand drying device sensors 81 that are used for activation of forced air.

Figure 26:
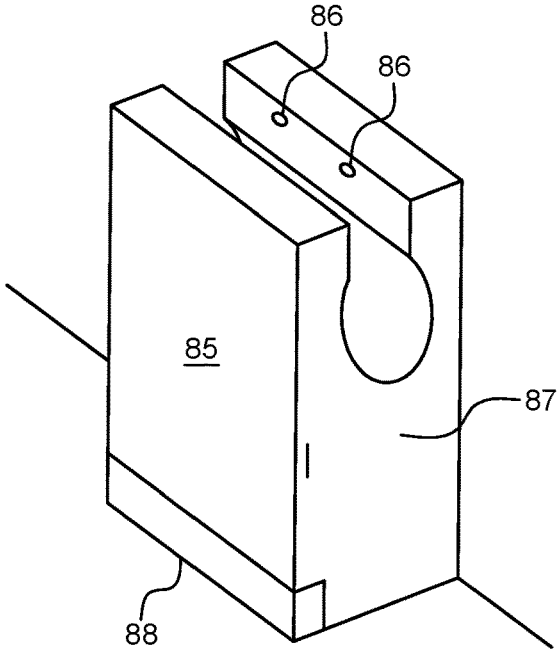
FIG. 26 is a perspective view of a device according to another non-limiting embodiment of the present invention illustrating a fixed unit integrated into a wall-mounted, forced-air, hand drying device.

FIG. 26 illustrates another non-limiting embodiment of the present invention. In this embodiment, the automatic floor cleaning and recovery unit is integrated into wall-mounted, forced-air, hand drying device 85. The mobile unit 88, in this embodiment, is activated on a synchronized basis with the hand drying device sensors 81, such that the mobile unit 88 is extended at a predetermined period of time after the de-activation of the hand drying device sensors 81 to allow time for people to step away from the device 85. Wall-mounted, forced-air, hand drying device 85 also has a side panel 87 to access the internal components of the integrated automatic floor cleaning and recovery unit.

Figure 27:
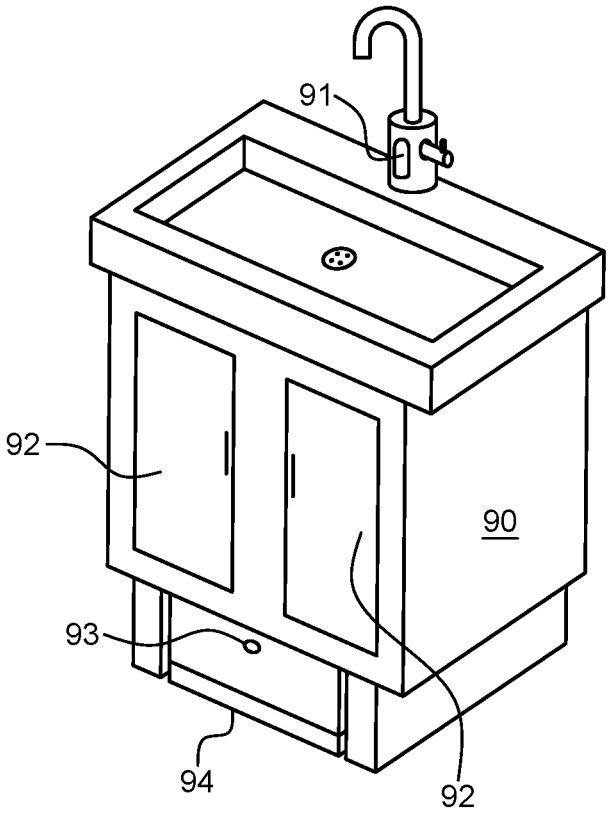
FIG. 27 is a perspective view of a device according to another non-limiting embodiment of the present invention illustrating a fixed unit housed within a floor-mounted sink.

FIG. 27 illustrates another non-limiting embodiment of the present invention. The automatic floor cleaning and recovery unit is housed within a floor-mounted sink cabinet 90. In this embodiment, the cleaning and recovery unit uses its own sensor 93 to activate the extension of mobile unit 94 independent of the faucet sensor 91 that is used to activate the flow of water. Floor-mounted sink cabinet 90 also has front panels 92 to access the internal components of the cleaning and recovery unit that is housed inside the sink cabinet 90.

According to a non-limiting embodiment of the present invention, a method of automatically cleaning a target area of a floor comprises the steps of (a) activating a sensor, (b) lifting and extending a mobile unit, (c) spraying disinfectant solution onto the target area of floor during extension of the mobile unit, (d) dropping the mobile unit so that the mobile unit comes into physical contact with the floor, and (e) retracting the mobile unit to recover waste solution. In a non-limiting embodiment of the invention, the retracting the mobile unit step (e) further comprises the steps of scrapping and suctioning.

According to another non-limiting embodiment of the present invention, a method of automatically cleaning a target area of a floor comprises the steps of (a) activating a sensor, (b) tilting and extending a mobile unit, (c) dropping the mobile unit so that the mobile unit comes into physical contact with the floor, (d) spraying disinfectant solution onto the target area of floor while retracting of the mobile unit, and (e) retracting the mobile unit to recover waste solution. In a non-limiting embodiment of the invention, the retracting the mobile unit step (e) further comprises the steps of scrapping and suctioning.

According to another non-limiting embodiment of the present invention, the method of automatically cleaning a target area of a floor comprises the steps of (a) activating a sensor, (b) extending and rotating a mobile unit, (c) spraying disinfectant solution onto the target area of floor during extension and rotation of the mobile unit, and (d) retracting the mobile unit.

The invention is not restricted to the embodiments described, but, on the contrary, covers any modification on form and any alternative form of embodiment that falls within the scope and spirit of the present invention. While there have been described what are believed to be preferred embodiments of the invention, those skilled in the art will recognize that other and further modifications may be made thereto, without departing from the spirit and scope of the present invention, as defined by the following claims.

What is claimed is:

1. An automatic floor cleaner comprising a cleaning and recovery unit wherein the cleaning and recovery unit comprises a fixed unit, a mobile unit, and an extension mechanism connected to the fixed unit and the mobile unit to permit the extension and retraction of the mobile unit from and to the fixed unit, wherein the fixed unit comprises a controller, a sensor, a motor, a power source, a disinfectant solution tank, a vacuum, and a recovery tank.

2. The automatic floor cleaner of claim 1, wherein the controller and the sensor control the activation of the motor for the extension or retraction of the mobile unit.

3. The automatic floor cleaner of claim 1, wherein the power source is AC or DC.

4. The automatic floor cleaner of claim 1, wherein the sensor is mounted on the exterior of the cleaning and recovery unit with a line of view in the direction of a target area of floor.

5. The automatic floor cleaner of claim 1, wherein the sensor is mounted on a urinal, toilet, sink, or hand drying device.

6. The automatic floor cleaner of claim 1, wherein the disinfectant solution tank is connected by tubing to the mobile unit for spraying disinfectant solution onto a target area of floor upon extension of the mobile unit from the fixed unit.

7. The automatic floor cleaner of claim 6, wherein the timing of spraying disinfectant solution is controlled by the controller.

8. The automatic floor cleaner of claim 1, wherein the vacuum further comprises its own collection tank, fan, motor, and exhaust port.

9. The automatic floor cleaner of claim 8, wherein the vacuum is connected by tubing to the mobile unit for recovery of urine and disinfectant solution from the target area of floor upon retraction of the mobile unit to the fixed unit.

10. The automatic floor cleaner of claim 8, wherein timing of the vacuum is controlled by the controller.

11. The automatic floor cleaner of claim 8, wherein the vacuum collection tank is connected by tubing to the recovery tank.

12. The automatic floor cleaner of claim 11, wherein an intake port of the vacuum is connected by tubing to the fixed unit in proximity of the mobile unit for the recovery of urine and disinfectant solution from a target area of floor upon retraction of the mobile unit to the fixed unit.

13. The automatic floor cleaner of claim 1, wherein the recovery tank is connected to an external drain or replaced by tubing connected directly to the external drain.

14. An automatic floor cleaner comprising a cleaning and recovery unit wherein the cleaning and recovery unit comprises a fixed unit, a mobile unit, and an extension mechanism connected to the fixed unit and the mobile unit to permit the extension and retraction of the mobile unit from and to the fixed unit, wherein the fixed unit is housed within a urinal, toilet, sink, or hand drying device.

15. The automatic floor cleaner of claim 14, wherein the fixed unit is a cartridge insertable into and removable from a cavity in the urinal, toilet, sink, or hand drying device.

16. An automatic floor cleaner comprising a cleaning and recovery unit wherein the cleaning and recovery unit comprises a fixed unit, a mobile unit, and an extension mechanism connected to the fixed unit and the mobile unit to permit the extension and retraction of the mobile unit from and to the fixed unit, wherein the mobile unit further comprises a spray port for spraying disinfectant solution onto a target area of floor, a recovery port for suctioning solution from the target area, and a scrapping implement for contacting the target area and collecting solution from the target area upon retraction of the mobile unit to the fixed unit.

17. The automatic floor cleaner of claim 16, wherein the scrapping implement is a squeegee.

18. An automatic floor cleaner comprising a cleaning and recovery unit wherein the cleaning and recovery unit comprises a fixed unit, a mobile unit, and an extension mechanism connected to the fixed unit and the mobile unit to permit the extension and retraction of the mobile unit from and to the fixed unit, wherein the extension mechanism first lifts and then extends the mobile unit, and wherein the retraction mechanism first drops and then retracts the mobile unit.

19. A method of automatically cleaning a floor surface using a cleaning and recovery unit, comprising the steps of (a) activating a sensor, (b) extending a mobile unit, (c) spraying disinfectant solution onto a target area of floor during extension of the mobile unit, (d) contacting the mobile unit with the floor, and (e) retracting the mobile unit over the target area.

20. The method of claim 19, wherein the step of retracting the mobile unit further comprises the steps of scraping and suctioning.

21. The method of claim 19, wherein the step (a) is replaced by activating on a timed basis.

22. The method of claim 19, wherein the step (c) is replaced by spraying disinfectant solution onto a target area of floor during retraction of the mobile unit.

23. An automatic floor cleaner comprising a cleaning unit, wherein the cleaning unit comprises a fixed unit, a mobile unit, and an extension mechanism connected to the fixed unit and the mobile unit to permit the extension and retraction of the mobile unit from and to the fixed unit, wherein the fixed unit comprises a controller, a sensor, a motor, a power source, and a disinfectant solution tank, and further wherein the disinfectant solution tank is connected by tubing to the mobile unit for spraying disinfectant solution onto a target area of floor upon extension of the mobile unit from the fixed unit.

24. A method of automatically cleaning a floor surface using the cleaning unit of claim 23, comprising the steps of (a) activating the sensor, (b) extending the mobile unit, (c) spraying disinfectant solution onto the target area of floor during extension of the mobile unit, and (d) retracting the mobile unit.

25. The method of claim 23, wherein the mobile unit is extended on a timed delay at predetermined time periods after the sensor is activated.

* * * * *